United States Patent [19]

Applegate et al.

[11] 4,396,308

[45] Aug. 2, 1983

[54] RIBBON GUIDING FOR THERMAL LIFT-OFF CORRECTION

[75] Inventors: Steven L. Applegate; James J. Molloy; Donald A. Walker, all of Lexington, Ky.

[73] Assignee: International Business Machines Corporation, Armonk, N.Y.

[21] Appl. No.: 292,553

[22] Filed: Aug. 13, 1981

[51] Int. Cl.[3] ..... B41J 29/16

[52] U.S. Cl. ..... 400/696; 400/120; 400/248; 400/241.1

[58] Field of Search ..... 400/118, 120, 229, 240.1, 400/241, 241.1, 696, 248; 101/1

[56] References Cited

U.S. PATENT DOCUMENTS

| | | | |
|---|---|---|---|
| 3,744,611 | 7/1973 | Montanari et al. | 400/120 |
| 3,825,437 | 7/1974 | Blair | 400/241.1 X |
| 3,825,470 | 7/1974 | Elbert et al. | 400/241.1 X |
| 3,855,448 | 12/1974 | Hanagata et al. | 400/120 X |
| 3,924,728 | 12/1975 | Brown et al. | 400/696 |
| 3,998,314 | 12/1976 | Barouh et al. | 400/696 |
| 4,034,843 | 7/1977 | Newman et al. | 400/241.1 X |
| 4,093,772 | 6/1978 | Taylor et al. | 400/696 X |
| 4,103,066 | 7/1978 | Brooks et al. | 400/241.1 X |
| 4,329,071 | 5/1982 | Applegate et al. | 101/1 X |
| 4,329,075 | 5/1982 | Applegate et al. | 400/229 |
| 4,345,845 | 8/1982 | Bohnhoff et al. | 400/120 |

FOREIGN PATENT DOCUMENTS

| | | | |
|---|---|---|---|
| 21874 | 2/1981 | Japan | 400/120 |
| 46774 | 4/1981 | Japan | 400/120 |

OTHER PUBLICATIONS

IBM Technical Disclosure Bulletin, "Delayed Tack Ribbon for Laser Transfer and Other Printing", Bruce et al., vol. 19, No. 2, Jul. 1976, p. 672.

IBM Technical Disclosure Bulletin, "Electrothermal Ribbon Path, Applegate et al., vol. 23, No. 5, Oct. 1980, p. 2012.

IBM Technical Disclosure Bulletin, "Color Thermal--Transfer Printing", Edgar et al., vol. 23, No. 7A, Dec. 1980, pp. 2633-2634.

*Primary Examiner*—Ernest T. Wright, Jr.

*Attorney, Agent, or Firm*—John A. Brady

[57] ABSTRACT

In thermal printing the guide (29) positionable toward the platen (3) on a pivoted arm (50) during lift-off correction allows a bond for correction to set before the ribbon (22) is pulled away. The ribbon (22) has an outer layer which adheres to printed characters at somewhat elevated temperatures but is non-tacky at room temperatures. Thermal printing is conducted by setting the switch (44) for heating to temperatures higher than the lift-off temperature.

5 Claims, 2 Drawing Figures

RIBBON GUIDING FOR THERMAL LIFT-OFF CORRECTION

DESCRIPTION

Cross-Reference to Related Application

In U.S. application Ser. No. 292,552, filed on the same day as this application by Clifford W. Anderson, Hugh T. Findlay and Nancy C. Watkins as inventors, entitled "Laminated Element, Thermal Printer and Process for Lift-Off Correction," and assigned to the same assignee as this application is assigned an invention is described upon which this constitutes an improvement.

TECHNICAL FIELD

This invention relates to lift-off correction of thermal printing in which the printing element is also the correcting element.

BACKGROUND ART

The foregoing application is to an invention communicated to the inventors of this application, after which this invention is made.

Thermal printing of the kind involved is in the nature of non-impact typewriting. Printing is by flow of melted material from a transfer medium which appears similar to a one-use typewriter ribbon. A lower lamination of the ribbon is heated, and printing is achieved by transferring ink from the ribbon to paper by means of local heating.

The foregoing application discloses an invention in which the correction ribbon is actually the marking ribbon. The outer material is colored for visibility of printing and melts at one temperature to thereby flow to a paper or other surface with which it is in contact. That same material is selected to become tacky at a temperature level between the printing temperature and room temperature. In practice the printer is backed over the erroneous character, the intermediate heat is applied, and the heated area is allowed to cool so that the bond sets before the ribbon is moved away from the printing plane.

As communicated to the inventors of this application, the ribbon feed during correction was beneficially changed from that during printing by the manual introduction of slack in the ribbon. The slack was introduced in the side near the ribbon supply. Although not apparent, during printing the slack portion would tend to stay on the paper, rather than being rolled toward the take-up spool immediately. This inherently introduced a delay which allowed the area heated during lift-off correction to cool before the ribbon was moved away from the printing plane.

DISCLOSURE OF THE INVENTION

In accordance with this invention, it is recognized that a mechanical guide member may be employed to create a span of ribbon parallel to the paper during correction. This holds the ribbon stationary relative to the paper after heating until the printhead moves the distance of the span.

With the presently known ribbons which appear suitable as the basis of commercial ribbons of the type here of interest, introduction of substantial delay before pulling the ribbon from the character during correction presently appears necessary for commercially satisfactory results. The moveable guide member accomplishes this automatically and effectively.

BRIEF DESCRIPTION OF THE DRAWING

The printer mechanisms of this invention are illustrated, primarily in a representative form, by the drawing.

BEST MODE FOR CARRYING OUT THE INVENTION

Figure 1:
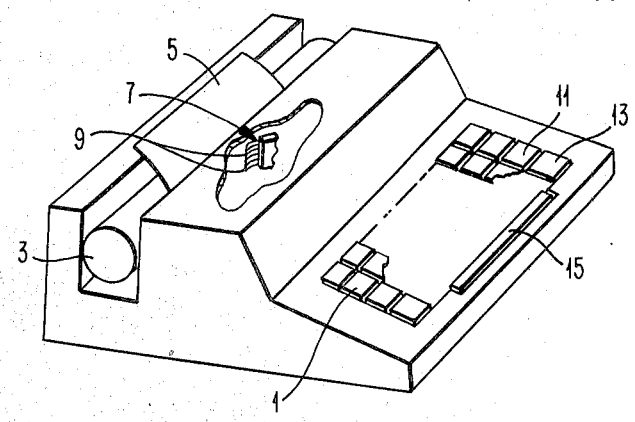
FIG. 1 shows an illustrative typewriter system.

As shown illustratively in FIG. 1, the printer is a typewriter having the usual keyboard 1, a platen 3 upon which paper 5 to be printed upon is supported and a thermal printing element or printhead 7 with a group of small electrodes 9 to effect printing of a selected character image. Selection of individual electrodes 9 as the printhead 7 is moved across the paper 5 makes possible the combination of minute dots of image which can be combined to form virtually any image.

One of the keybuttons 11 effects ordinary backspacing while another keybutton 13 effects the erasure operation to be described. Another key 15 effects forward spacing. Sequencing and other control of typewriter operations in response to operations of keyboard 1 is under control of electrical logic and digital processing systems, as is now conventional in general respects in electronic typewriters (for example, see U.S. Pat. No. 4,345,845 to Bohnhoff et al for a printer control).

In FIG. 1 the printhead 7 is shown broken away on the side toward the keyboard 1. The remaining structure is sufficiently indicated in FIG. 2. Toward the platen 3, The supporting structure of printhead 7 is shown broken away to emphasize the single vertical row of electrodes 9 which are mounted within the printhead 7. During normal printing each electrode 9 is either connected to printing potential or not connected, depending upon the pattern to be printed.

Figure 2:
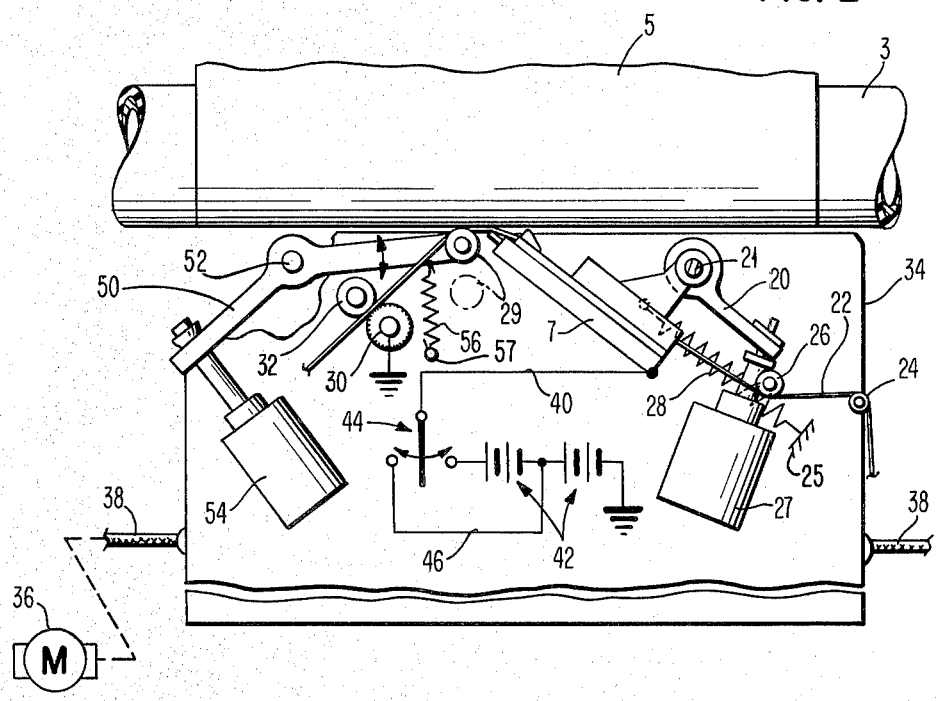
FIG. 2 shows a top view of such a system including the ribbon and the moveable guide member.

FIG. 2 is a top view, also generally illustrative only, of the printing and erase area. Positioning member 20, pivoted at point 21, is attached to printhead 7. A ribbon 22 is unwound from a supply spool (reel 114 in U.S. Pat. No. 4,329,075 to Applegate et al. is illustrative) around tensioning roller 24, across a guide roller 26, and to the end of printhead 7. Solenoid 27 is linked to an arm of positioning member 20, and, when energized as shown in FIG. 2, pulls member 20 clockwise to force the end of printhead 7 against paper 5 mounted on platen 3. When solenoid 27 is de-energized, spring 28, connected to member 20 and to a point on the mechanism frame 25, pulls member 20 counterclockwise to thereby move printhead 7 away from paper 5.

Ribbon 22 is pressed between the end of printhead 7 and paper 5 when solenoid 27 is activated. Ribbon 22 is then in contact with the ends of the vertical column of electrodes 9 (FIG. 1), which are mounted in printhead 7. Guide member 29 is selectably movable toward and away from platen 3. During correction guide member 29 is moved toward platen 3 to present a face at paper 5 a distance selected to be about 6 millimeters prior to the printing position. When member 29 is in the erase position, shown in FIG. 2, ribbon 22 is thereby positioned flat with the paper 5 at the printing point and for about 6 mm prior to the printing point. In a typical printing operation, 6 mm is about the width of two to four characters.

Metering of the ribbon 22 is effected by cooperating metering rollers 30 and 32 located on the take-up side of printhead 7. Roller 30 is arranged on the side of the ribbon 22 that faces printhead 7 and is mounted at a fixed position with respect to printhead 7. Firm pressure contact with ribbon 22 is achieved by mounting roller 32 such that it is movable toward roller 30 and biased to provide a nipping force. Roller 30 is driven with each printing operation an amount approximately equal to the width of printing movement effected, so that the printhead 7 moves across paper 5 and with the ribbon 22 having no substantial motion in the direction of printing movement relative to the paper 5.

Roller 30 is formed of a conducting material such as brass and is preferably knurled to assure intimate contact and firm gripping. Current from the electrodes 9 in printhead 7 is collected by the electrically grounded roller 30 through contact with the side of the ribbon 22 which it contacts, which side is resistive as will be more fully discussed.

Such operation and design of a thermal printer may be conventional, except for the guide member 29 and associated elements. Typically, the printhead 7 and the ribbon-guide rollers 24, 26, 30 and 32 are mounted on a carrier 34 which moves across the length of a stationary platen 3. For movement across the print line, carrier 34 is attached to an electrical motor 36, which drives a belt or cable 38, the ends of which are connected to opposite sides of carrier 34.

An electrical lead, shown illustratively as a single wire 40, connects the electrodes 9 (FIG. 1) of printhead 7 to an electrical power source or power supply 42. A switch 44 has two positions, a print position at which the full potential of power supply 42 is connected to the electrodes 9 and a correct position at which a connection is made to line 46 which results in a portion of the power of supply 42 being applied to the electrodes 9.

The ribbon 22 is a three layer element of an active material (22 in the foregoing U.S. Pat. No. 4,345,845 illustrates the position) of typically 4 to 6 microns in thickness, a 1000 Angstrom intermediate layer (20 in the foregoing U.S. Pat. No. 4,345,845) of aluminum which serves as a current return path, and a resistive outer substrate (18 in FIG. 1 in the foregoing U.S. Pat. No. 4,345,845) typically 15 microns in thickness. The ribbon 22 is, of course, wide enough to fit across the entire vertical row of electrodes 9.

Since printing is by complete release, ribbon 22 must be incremented with each printing step. Printing is effected by energizing selected one of the electrodes 9 while those electrodes 9 are in contact with the resistive substrate of ribbon 22. The substrate is also in contact with a borad, conductive area of roller 30, which disperses current beyond the location of electrodes 9. The high current densities in the areas near the energized point electrodes 9 produce intense local heating which causes, during printing, melting of the active material and resulting flow onto the paper 5.

Guide member 29 presents a smooth, surface upon which ribbon 22 rests. Member 29 is mounted on the end of arm 50, which is pivoted to carrier 34 at point 52. The other side of arm 50 is linked to solenoid 54. Spring 56 connects to arm 50 near member 29, with the other end connected to a point 57 on carrier 34. (It will be apparent that this structure is effective and simple, but that in a commercial machine a design would be chosen which is dictated by space available and which avoids the use of a solenoid just for the movement of guide member 29.)

This constitutes a motive assembly linked to guide member 29 to render guide member 29 selectably movable toward and away from platen 3. During printing solenoid 54 is not energized. Spring 56 therefore pulls arm 50 clockwise to bring guide member 29 away from platen 3 to the position shown in dotted outline in FIG. 2. Therefore, during printing ribbon 22 is pulled away from paper 5 while still hot. During lift-off correction solenoid 54 is energized pivoting arm 50 counterclockwise and bringing guide member 29 toward platen 3 so that ribbon 22 is held against paper 5 in the span between printhead 7 and guide member 29.

RIBBON MATERIALS

Polycarbonate is used as the resin material of the substrate of the ribbon 22 employed. A representative teaching of the fabrication of a polycarbonate substrate for this purpose is disclosed in U.S. Pat. No. 4,103,066 to Brooks et al. A dispersion is coated on a polyethylene terephthalate substrate to the desired dry thickness. An electrically conductive intermediate layer of aluminum of 1000 Angstrom is vacuum deposited upon this substrate. The aluminum is then overcoated by a dispersion of the material which will constitute the active layer. Upon drying, the combined three layer ribbon 22 is stripped from the polyethylene terephthalate substrate. It is slit to the desired width and wound onto a spool.

The active layer may have a single ingredient as the latently tacky material, but the desired properties are usually achieved with a blend. Satisfactory results can be expected from a combination of a thermoplastic resin, such as a polyamide, with a compatible, normally highly viscous material, such as gum rosin. Similarly, satisfactory results can be expected from the combination of two similar thermoplastic materials having low and intermediate softening points.

The ribbon 22 employed has an active layer of about 69 parts by weight ethylene vinyl acetate copolymer, about 15 parts by weight of a compatible acrylic polymer, and about 11 parts by weight carbon black.

LIFT-OFF ERASURE OPERATION

Upon discovery by the operator of a character which is incorrect, lift-off correction is effected by first positioning the printhead 7 to act as in printing at the location of the incorrect character. Platen 3 is located to select the line. Backspace key 11 or forward-space key 15 are operated until printhead 7 is positioned to print at the location occupied by the character to be erased.

The machine operator depresses the erase key 13 and the key on keyboard 1 for the character to be erased. This effects the operations of normal printing of the character to be erased with exceptions as follows in the specific embodiment being described. (In a memory-assisted embodiment, the character to be erased would be known automatically, so no key on keyboard 1 for that character need be depressed after erase key 13 is depressed.)

(1) Solenoid 54 is energized, thereby pivoting arm 50 to bring guide member 29 to the position near platen 3.

(2) Current to electrodes 9 is reduced. In the simplified and largely symbolic illustration of FIG. 2, switch 44 is brought to the leftward position, thereby contacting line 46 and providing only a part of the potential of power supply 42 to the electrodes 9.

(3) The speed of movement of printhead 7 and, correspondingly, movement of ribbon 22 may be reduced. However, speed reduction is not necessary with the specific embodiment disclosed and the same speed as printing is employed to simplify machine requirements.

(4) Print movement is across the character being corrected and for 6 more millimeters, the electrodes 9 not being powered after being powered to form the character to be erased. The location upon termination of the erase operation is 6 mm past the character erased. The extra space provides a delay for cooling prior to the peeling of ribbon 22 with erased character attached from the page. And, (5) Printhead 7 may be automatically returned to a position for printing in the now-clean space previously occupied. A character desired in that space may be printed by depressing the key associated with it. Printhead 7 may be moved forward at any time by operating space key 15, or by operating other keys of keyboard 1 as is conventional.

PARAMETERS OF THE EMBODIMENTS

It will be recognized that the specific parameters are interdependent and that selection of one in a specific implementation can be as desired so long as the other parameters have corresponding characteristics. Thus, a thicker ribbon 22 tends to require higher current at electrodes 9, although an active layer which melts easily might negate this. Such adjustments are simply a matter of ordinary optimization of design.

Accordingly, the parameters to be mentioned are those of one embodiment as described and should be considered basically illustrative, rather than particularly significant to any embodiment. The normal printing current at each electrode 9 is 26 milliamperes (ma). During lift-off correction the current to each electrode 9 is 6–12 ma. The speed of movement of printhead 7 during normal printing is 2½ inches (6.35 cm) per second. When the speed of movement of printhead 7 is reduced during lift-off correction, a typical speed is 1½ inches (3.81 cm) per second. Return of printhead 7 after correction uses ordinary printer capabilities. The 6 mm span between printhead 7 and guide member 29 was the result of available space in the specific implementation and might desirably be less in other embodiments.

MECHANISM OF LIFT-OFF

During the erasure operation the ribbon 22 is held in contact with printing on paper 5 after the initial heating. This is accomplished by guide member 29, which is then contiguous to paper 5, as is the end of printhead 7. Accordingly, the intermediate heat for erasure is applied, but the ribbon 22 stays in contact with paper 5 for the time of printing movement through about 6 mm, at which point ribbon 22 clears member 29 and is directed away from paper 5 toward the nip of rollers 30 and 32 (FIG. 2).

This period of contact with the character to be lifted-off permits a bond to be formed between the active layer of ribbon 22 and the printed character. No such bond is observed if ribbon 22 is pulled away immediately after the application of the intermediate heat. The bond is therefore dependent upon both the heating and the cooling.

The lower level of heat supplied during erasure does not cause the active layer of ribbon 22 to flow, but does produce an affinity or tack toward the printed character, which is, of course, of the same material since the characters are printed from the same ribbon 22. The subsequent cooling sets the adhesive bond.

It is known from experience that correction is sometimes facilitated using the disclosed embodiment when movement during correction is slower than movement during printing. This is not thought to be fundamental to the mechanism of all suitable implementations in accordance with this invention. The slower movement provides added time, and cooling time is known to be needed for the bond for correction to set. Also, the slower movement results is a less vigorous pulling away when ribbon 22 does clear member 29 and is pulled away from paper 5. These and other such factors would not necessarily be significant in other implementations.

It will be apparent that the essential characteristics of guide member 29 may take various form, but all within the spirit and scope of this invention. Accordingly, patent coverage should not be limited by the specific embodiment herein disclosed, but should be as provided by law, with particular reference to the following claims.

What is claimed is:

1. A thermal printer having a power source to power heat-producing elements which can be selectably activated in the form of a character to be printed while in contact with a ribbon of thermal transfer medium from which marking material flows when heated by said elements, keyboard selection means to select a lift-off correction mode of operation, and means operative during said lift-off correction mode of operation to apply power from said power source to said ribbon in a substantial amount, said amount being less than power to effect said printing, while activating selected ones of said elements wherein the improvement comprises a ribbon guide positionable in response to selection of said lift-off correction mode of operation by said keyboard selection means to guide said ribbon in contact with printing made by said printer a distance past the point of printing sufficient to permit a bond for lift-off correction to form.

2. The thermal printer as in claim 1 wherein said ribbon guide is mounted for movement to a first position to guide said ribbon in contact with printing made and a second position away from said first position, motive means, means linking said ribbon guide to said motive means for movement to said first and said second position under control of said motive means, and control means for operating said motive means to move said ribbon guide to said first position during correction and to said second position during printing.

3. The thermal printer as in claim 2 wherein said motive means and said linking means comprise biasing means normally positioning said ribbon guide in one of said first and said second positions, a solenoid, and means connecting said solenoid to said ribbon guide wherein activation of said solenoid overcomes said biasing means and positions said guide in the other of said first and said second positions.

4. The thermal printer as in claim 1, 2 and 3 therein said printer comprises a printhead and a paper-receiving platen and during printing said printhead contacts said transfer medium and said transfer medium contacts paper received on said platen and wherein said ribbon guide during lift-off correction positions said transfer medium in contact with paper received on said platen at least one character width past the point of printing.

5. The thermal printer as in claim 4 wherein said ribbon guide during lift-off correction positions said transfer medium in contact with paper received on said platen about 6 millimeters past the point of printing.

* * * * *